US005844357A

United States Patent [19]

Iida et al.

[11] Patent Number: 5,844,357

[45] Date of Patent: Dec. 1, 1998

[54] LIGHT-BULB-SHAPED FLUORESCENT LAMP

[75] Inventors: Shiro Iida; Takeshi Matsumura, both of Osaka; Kenji Nakano, Kyoto; Kenji Itaya, Osaka, all of Japan

[73] Assignee: Matsushita Electronics Corporation, Osaka, Japan

[21] Appl. No.: 885,359

[22] Filed: Jun. 30, 1997

[30] Foreign Application Priority Data

Jul. 1, 1996 [JP] Japan ..... 8-170844

[51] Int. Cl.[6] ..... H01J 17/16; H01J 61/30

[52] U.S. Cl. ..... 313/493; 313/634; 313/318.02

[58] Field of Search ..... 313/493, 634, 313/318.02, 485, 564, 565, 639, 642, 44; 362/260

[56] References Cited

U.S. PATENT DOCUMENTS

| | | | |
|---|---|---|---|
| 4,298,822 | 11/1981 | Fukuda | 313/493 |
| 4,772,819 | 9/1988 | Ridders | 313/493 |
| 4,871,944 | 10/1989 | Skwirut et al. | 315/56 |
| 4,952,187 | 8/1990 | Ake | 313/493 |
| 5,675,215 | 10/1997 | Watson et al. | 313/493 |
| 5,680,005 | 10/1997 | Soules et al. | 313/493 |
| 5,729,079 | 3/1998 | Franck | 313/634 |
| 5,739,633 | 4/1998 | Biro et al. | 313/49.3 |
| 5,751,104 | 5/1998 | Soules et al. | 313/493 |

FOREIGN PATENT DOCUMENTS

| | | | |
|---|---|---|---|
| 0 118 100 | 9/1984 | European Pat. Off. | H01J 61/34 |
| 0 152 264 | 8/1985 | European Pat. Off. | H01J 61/32 |
| 0 231 957 | 8/1987 | European Pat. Off. | H01J 61/32 |
| 5-074417 A | 3/1993 | Japan | H01J 61/28 |
| 8-077971 A | 3/1996 | Japan | H01J 61/28 |
| 2 176 648 | 12/1986 | United Kingdom | H01J 61/36 |

OTHER PUBLICATIONS

Communication from the UK Patent Office (25 Sep. 1997) and attached Search Report.

*Primary Examiner*—Sandra O'Shea
*Assistant Examiner*—Michael Day
*Attorney, Agent, or Firm*—Merchant, Gould, Smith, Edell, Welter & Schmidt, P.A.

[57] ABSTRACT

A light-bulb-shaped fluorescent lamp accommodates in an outer housing that includes a transparent globe and a case, a bent fluorescent tube that has a pair of electrodes at both ends and contains an amalgam and a rare gas, and an electronic lighting circuit lighting the fluorescent tube. A light-bulb-shaped fluorescent lamp which has high conformity to regular light bulbs and realizes the same brightness as a regular 60 W light bulb while consuming less power than a conventional light-bulb-shaped fluorescent lamp is provided by setting the external diameter of the globe in the range of 55–65 mm, the total length of the globe in the range of 65–80 mm, the internal diameter of the fluorescent tube in the range of 7–11 mm, and the distance between the electrodes in the range of 200–280 mm.

10 Claims, 9 Drawing Sheets

LIGHT-BULB-SHAPED FLUORESCENT LAMP

FIELD OF THE INVENTION

The present invention relates to a light-bulb-shaped fluorescent lamp. Currently, 60 W rated power light bulbs constitute the largest market share in the market for regular (incandescent) light bulbs, so that substitute light-bulb-shaped fluorescent lamps with only 15 W power consumption, but having the same brightness as a regular light bulb (ca. 800 lumen), are most widely used.

BACKGROUND OF THE INVENTION

A conventional light-bulb-shaped fluorescent lamp (FIGS. 8 and 9) accommodates a fluorescent tube 5 and an electric lighting circuit 4 inside an outer housing 3 including a globe 1 and a case 2. The globe 1 has an external diameter of about 70 mm and a total length of about 80 mm, and the fluorescent tube 5 has an internal diameter of 13–14 mm. 6 is an amalgam container.

High conformity with regular light bulbs is demanded of the light-bulb-shaped fluorescent lamp, since it is an energy saving light source to be substituted for regular light bulbs. However, the globe of conventional light-bulb-shaped fluorescent lamps, having an external diameter of about 70 mm, still exceeds the 60 mm external diameter of regular light bulbs, and this gives rise to the problem of a lack in conformity with regular light bulbs.

However, if fluorescent tubes in conventional use with a 13–14 mm internal diameter are accommodated in compact globes with an external diameter under 65 mm and a total length under 80 mm, then the temperatures of the fluorescent tube and the electronic lighting circuit rise considerably due to the reduction of the internal volume. This brings about deterioration of the conversion efficiency of the phosphor applied to the inner surface of the fluorescent tube, and deterioration of the conversion efficiency of the electronic lighting circuit. Here, conversion efficiency of the phosphor means the efficiency with which ultra-violet light is converted into visible light, and conversion efficiency of the electronic lighting circuit means the ratio of electric input power to electric output power.

Furthermore, temperature deterioration of electronic parts gives rise to operational errors or a shorter life expectancy of the electronic lighting circuit, so that a compact globe design with an external diameter of under 65 mm and a total length of under 80 mm could not be realized so far.

On the other hand, in recent years, and especially from the view-point of energy saving for environmental protection, there is a great demand for a light-bulb-shaped fluorescent lamp with low electric power consumption.

SUMMARY OF THE INVENTION

The present invention was developed to overcome the above mentioned problems of the prior art. Thus, it is the object of the present invention to provide a light-bulb-shaped fluorescent lamp which exhibits high conformity to regular light bulbs, and realizes the brightness of a regular 60 W light bulb while consuming even less electric power than conventional light-bulb-shaped fluorescent lamps.

The light-bulb-shaped fluorescent lamp of the present invention comprises: a bent fluorescent tube that has a pair of electrodes at both ends and is filled with an amalgam and a rare gas; an electronic lighting circuit lighting the fluorescent tube; and an outer housing, including a transparent globe and a case and accommodating the bent fluorescent tube and the electronic lighting circuit. The light-bulb-shaped fluorescent lamp is further characterized in that the external diameter of the globe ranges between 55 mm and 65 mm, the total length of the globe ranges between 65 mm and 80 mm, the wall thickness of the globe ranges between 0.5 mm and 1.5 mm, the internal diameter of the fluorescent tube ranges between 7 mm and 11 mm, the wall thickness of the fluorescent tube ranges between 0.6 mm and 1.2 mm, and the distance between the electrodes ranges between 200 mm and 280 mm.

It is preferable that the fluorescent tube of the present invention has a tube wall load between 1.4 $mW/mm^2$ and 3.2 $mW/mm^2$ when lit.

Furthermore, the present invention can be applied to a W-shaped fluorescent tube that has three bent portions and provides a pair of electrodes on both ends.

Furthermore, the present invention can also be applied to a fluorescent tube formed by joining two U-shaped tubes with a bridge in the vicinity of their free ends.

Furthermore, the present invention can also be applied to a fluorescent tube formed by joining four straight tubes with three bridges.

Furthermore, it is preferable that the amalgam consists of at least one mercury gas generating compound selected from the group consisting of BiPbSnHg, BiInHg, and BiInPbHg.

Furthermore, it is preferable that the rare gas consists of at least one rare gas selected from the group consisting of argon gas and neon gas.

Furthermore, it is preferable that the distance between the electrodes ranges between 250 mm and 260 mm.

Furthermore, it is preferable that the rated power consumption ranges between 13.8 W and 15.2 W.

Furthermore, it is preferable that the internal diameter of the fluorescent tube ranges between 9 mm and 11 mm.

According to the present invention as described above, a light-bulb-shaped fluorescent lamp can be attained, which has high conformity with regular light bulbs and realizes the brightness of a regular 60 W light bulb while consuming less power than a conventional light-bulb-shaped fluorescent lamp.

DETAILED DESCRIPTION OF THE INVENTION

The preferred embodiments of the present invention are explained below on the basis of the FIGS. 1–7.

Figure 1:
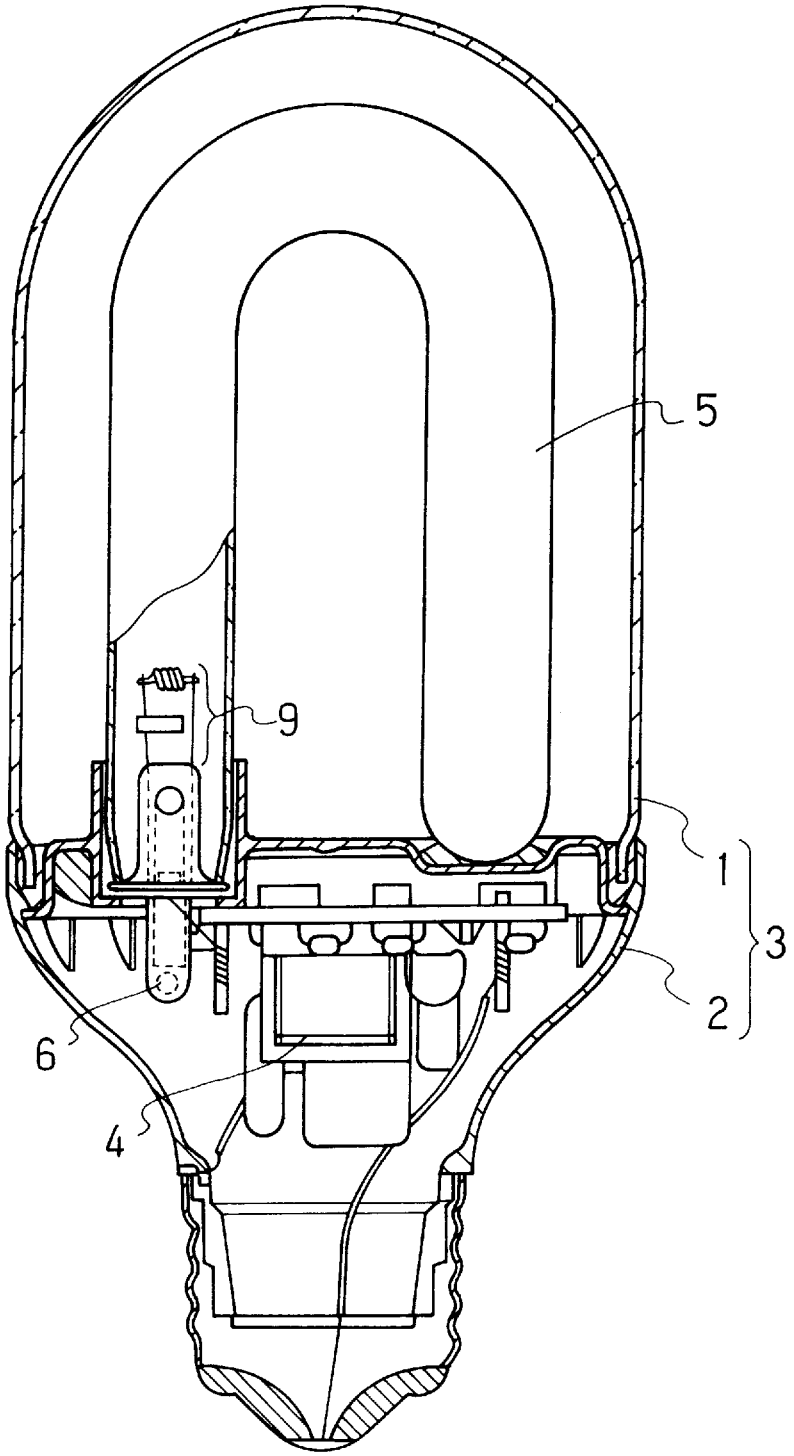
FIG. 1 is a sectional frontal view of a light-bulb-shaped fluorescent lamp according to a preferred embodiment of the present invention.

FIG. 1 shows a sectional frontal view of the light-bulb-shaped fluorescent lamp of the present invention. In FIG. 1, a globe 1 is made of a transparent resin or glass, has an external diameter of 60 mm, a total length of 77 mm, and a wall thickness of 1.0 mm. An outer housing 3 is composed of the globe 1 and a case 2. An electronic lighting circuit and a so-called W-shaped fluorescent tube 5 (see FIG. 2) that is bent at three places, has a wall thickness of 0.8–1.0 mm and is provided with a pair of electrodes 9 at both the tube's ends are arranged inside the outer housing. A 400 Pa argon gas is sealed in the fluorescent tube 5, and at one end an amalgam controlling the mercury vapor pressure is disposed in an amalgam container 6. Besides BiPbSnHg, it is also possible to use BiInHg or BiInPbHg or the like as an amalgam.

Figure 9:
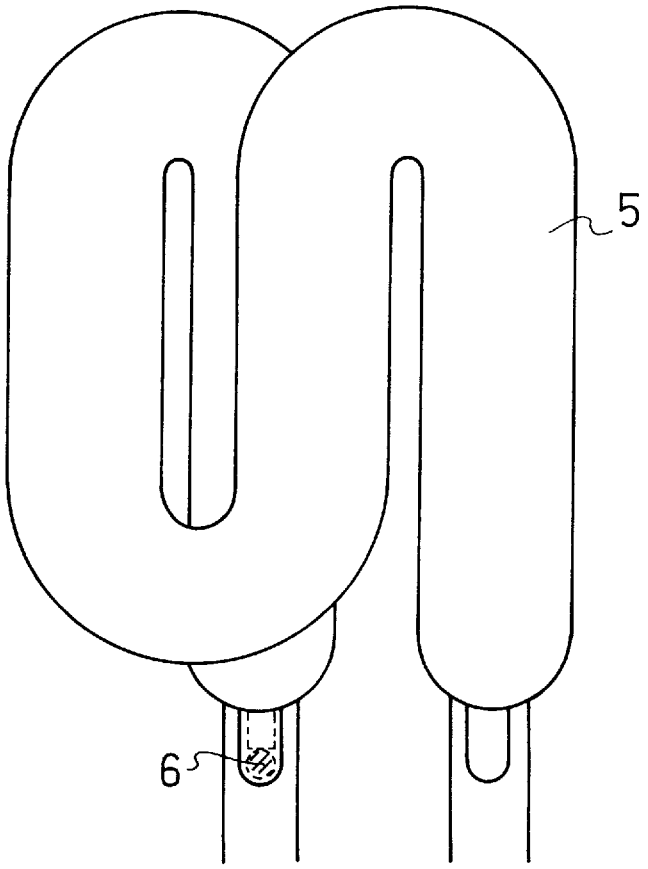
FIG. 9 (PRIOR ART)
FIG. 9 is a perspective view of a fluorescent tube of a conventional light-bulb-shaped fluorescent lamp.

If a fluorescent tube 5 with a conventional internal diameter of 13.5 mm as shown in FIG. 9 were arranged inside the globe 1, which has an external diameter of 60 mm and a total length of 77 mm and is thus more compact than conventional globes, then the temperature of the fluorescent tube 5 and the electronic lighting circuit 4 would rise considerably because of the reduction of the inner volume of the globe. This would not only bring about a drop of the conversion efficiency of the phosphor applied to the inner surface of the fluorescent tube and a drop of the conversion efficiency of the electronic lighting circuit, but also operational errors or a shorter life expectancy of the electronic lighting circuit due to temperature deterioration of electronic parts.

The inventors of the present invention have performed several investigations concerning those problems.

Figure 6:
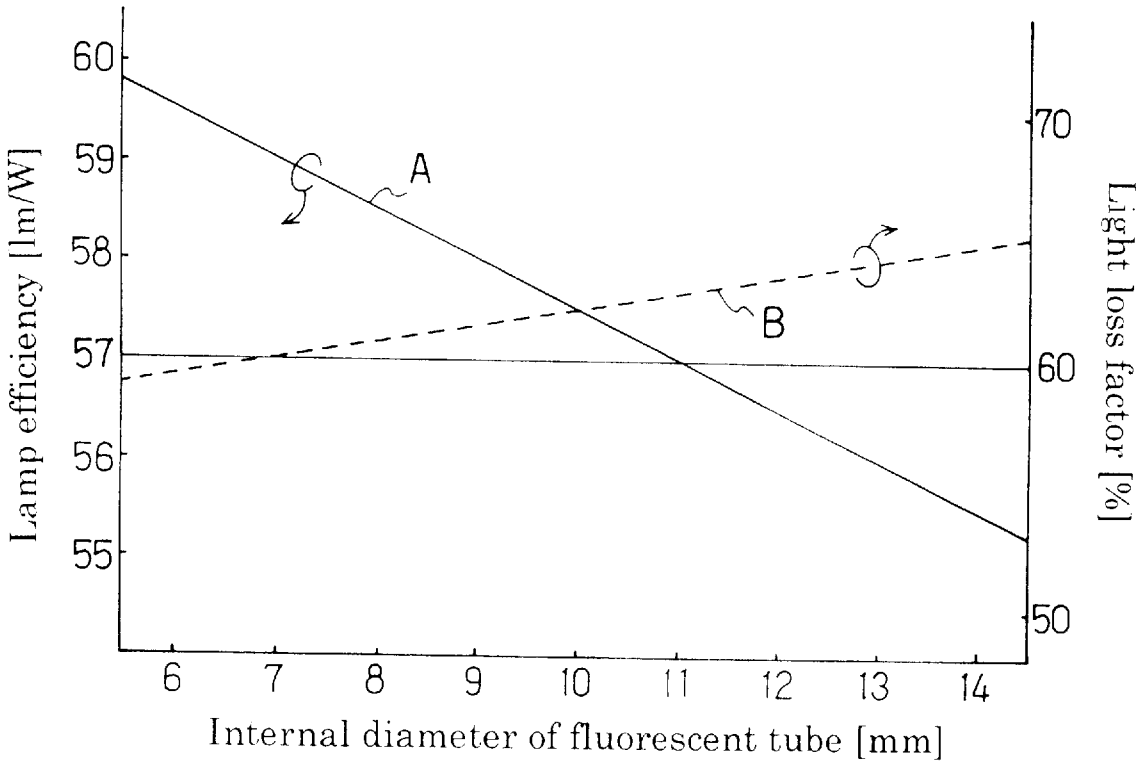
FIG. 6 shows the relationship between the internal diameter of a fluorescent tube according to the present invention and the lamp efficiency and light loss factor.

FIG. 6 shows the relationship between the internal diameter of the fluorescent tube on the one hand and the lamp efficiency and the light loss factor (total luminous flux after a 6000 hours lighting period / total luminous flux after a 100 hours lighting period×100%) on the other hand for a globe 1 having an external diameter of 60 mm and a total length of 77 mm, and a constant 14 W rated electric power consumption, 1 W lower than in conventional light-bulb-shaped fluorescent lamps. Furthermore, the distance of the electrodes 9 has been fixed at 280 mm, which is the largest distance that could be attained when the electrodes 9 are accommodated inside a globe 1 which has an external diameter of 60 mm and a total length of 77 mm.

First, the relationship between the internal diameter of the fluorescent tube and the lamp efficiency is explained. Here, the internal diameter of the fluorescent tube means the internal diameter of a straight portion of the fluorescent tube, and this internal diameter is constant. As the internal diameter of the fluorescent tube gets thicker, the temperature of the fluorescent tube 5 and the electronic lighting circuit 4 rises due to an increase of the lamp current. As a result, the conversion efficiencies of the phosphor applied to the inner surface of the fluorescent tube and of the electronic lighting circuit 4 drop, and thus the lamp efficiency drops, as is shown by the straight line A in FIG. 6. Because a lamp efficiency of 57 lm/W is necessary to attain the brightness of a regular 60 W light bulb at an electric power consumption of 14 W, it can be seen from the straight line A in FIG. 6 that the internal diameter of the fluorescent tube should be under 11 mm.

Next, the relationship between the internal diameter of the fluorescent tube and the light loss factor is explained. As is shown by the straight line B in FIG. 6, the light loss factor worsens as the internal diameter of the fluorescent tube gets thinner. This is a result from a reduction of the luminescent area of the fluorescent tube, and a rise of the tube wall load ($mW/mm^2$). In the case of a light-bulb-shaped fluorescent lamp, the time until lighting becomes impossible or the light loss factor falls short of 60% is generally regarded as the life-span. Consequently, it can be seen from the straight line B in FIG. 6 that the internal diameter of the fluorescent tube should be over 7 mm.

From the above result, it is possible to arrange a fluorescent tube in a compact globe 1 having an external diameter of 60 mm and a total length of 77 mm, and realize the same brightness as in a regular 60 W light bulb with a rated electric power consumption of 14 W that is 1 W lower than in conventional light-bulb-shaped fluorescent lamps, by effectuating an internal diameter of 7–11 mm for the fluorescent tube. Even more preferably, a light-bulb-shaped fluorescent lamp can be attained that has some clearance with respect to both lamp efficiency and light loss factor by using an internal diameter of 10 mm for the fluorescent tube.

Furthermore, it has been demonstrated that if the external diameter of the globe becomes less than 55 mm and the total length becomes less than 65 mm, then a drop in the conversion efficiency of the phosphor and the electronic lighting circuit 4 is brought about because of a rise of the temperature of the fluorescent tube 5 and the electronic lighting circuit 4 due to the reduction of the inner volume of the lamp, and operational errors or a shorter life expectancy of the electronic lighting circuit 4 are brought about because of temperature deterioration of electronic parts.

Figure 7:
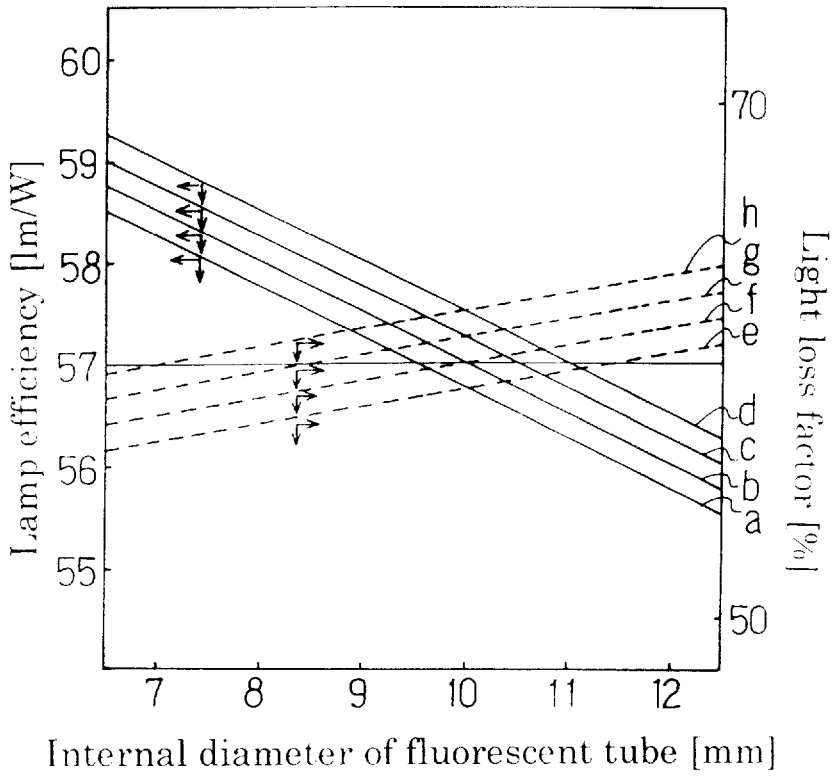
FIG. 7 similarly shows the relationship between the internal diameter of a fluorescent tube and the lamp efficiency and light loss factor for different distances between the electrodes.
Figure 8:
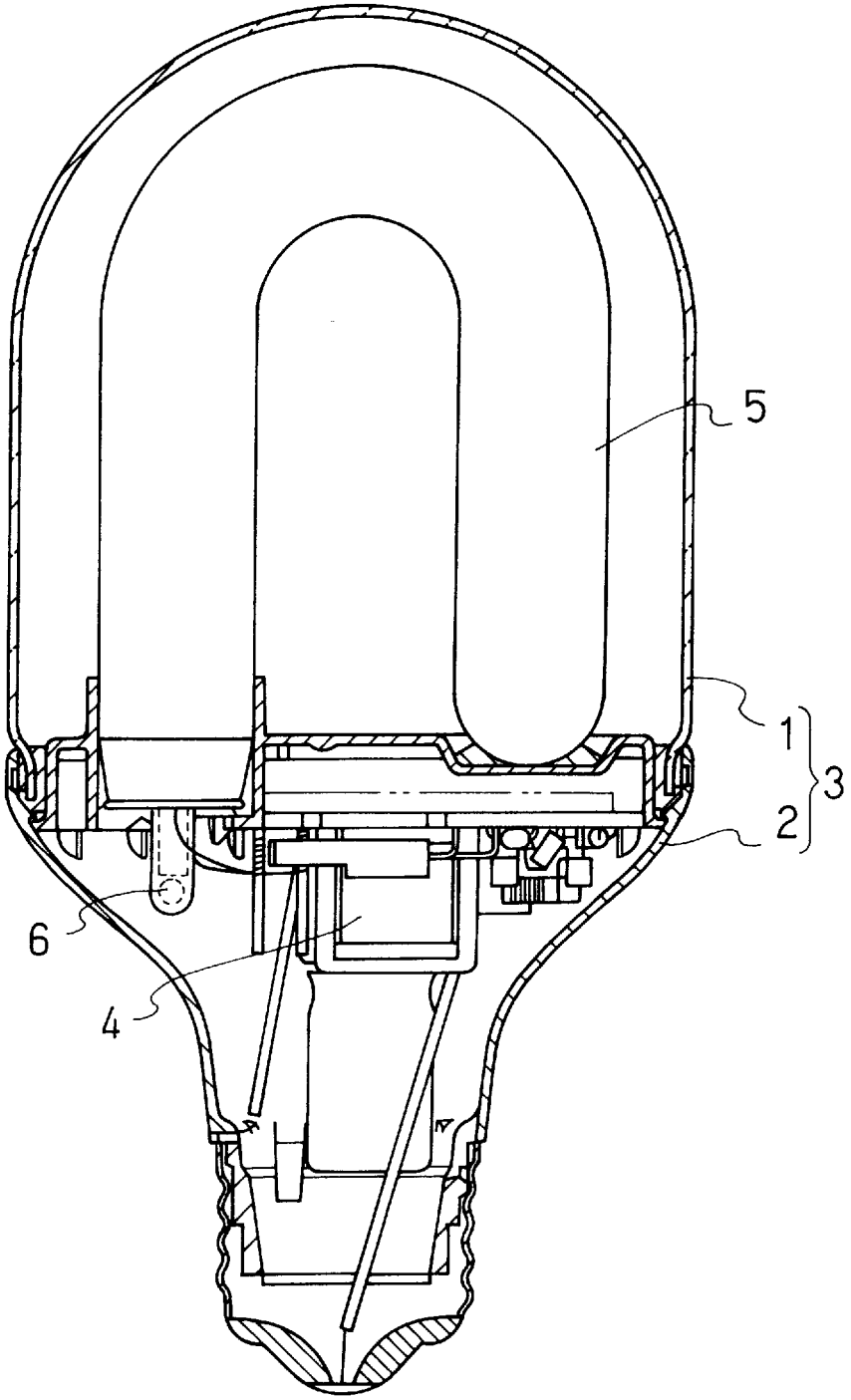
FIG. 8 (PRIOR ART)
FIG. 8 is a sectional frontal view of a conventional light-bulb-shaped fluorescent lamp.

Next, the relationship between the internal diameter of the fluorescent tube on the one hand and the lamp efficiency and light loss factor on the other hand has been determined for various electrode distances using a globe 1 that has an external diameter of 60 mm, a total length of 77 mm, and a constant 14 W electric power consumption. The result is shown in FIG. 7. In FIG. 7, the straight lines a–d show the relationship between the internal diameter of the fluorescent tube and the lamp efficiency, and the straight lines e–h show the relationship between the internal diameter of the fluorescent tube and the light loss factor. The distance between the electrodes is 180 mm for the lines a and e, 200 mm for the lines b and f, 220 mm for the lines c and g, and 240 mm for the lines d and h.

As can be seen from FIG. 7, in the range of 7–11 mm for the internal diameter of the light emitting tube, a distance between the electrodes of under 200 mm does not satisfy simultaneously the standards of 57 lm/W lamp efficiency and 60% light loss factor. This results from an increase in the lamp current as the distance between the electrodes 9 becomes smaller, causing the temperature of the fluorescent tube 5 and the electronic lighting circuit 4 to rise and the lamp efficiency to drop. Furthermore, the tube wall load increases due to a reduction of the luminescent area, and the light loss factor drops. Consequently, the distance between the electrodes 9 should be kept in the range of 200–280 mm. Here, the lamp efficiency and the light loss factor are better, the greater the distance between the electrodes 9. However, if the distance between the electrodes 9 exceeds 260 mm, then the gap between the globe 1 and the fluorescent tube 5 becomes small, and the danger arises that the globe 1 and the fluorescent tube 5 collide and are damaged due to e.g. vibrations or rough handling during transport. Consequently, the distance between the electrodes 9 should be as long as possible, but a length of about 250–260 mm, which results in reductions of such damage, is preferable.

If at a power consumption of 14 W the internal diameter of the fluorescent tube 5 is 7–11 mm, and the distance between the electrodes 9 is 200–280 mm as described above, then the tube wall load when the lamp is lit is in the range of 1.4–3.2 mW/mm$^2$. Thus, the present invention has the two effects of attaining high conformity with respect to regular light bulbs, and being environmentally friendly due to an energy saving operation.

Furthermore, the rated electric power consumption should be above 13.8 W in order to attain the same brightness as in a regular 60 W light bulb, but under 15.2 W from the viewpoint of energy saving and life expectancy.

Moreover, the larger the external diameter of the globe 1 is, the better are the characteristics, but if the external diameter is 65 mm or less and the total length is 80 mm or less, then there is no considerable lack in the conformity with regular light bulbs. On the other hand, as has been pointed out above, if the external diameter of the globe 1 is under 55 mm, or the total length is under 65 mm, then the conversion efficiencies of the phosphor and the electronic lighting circuit 4 drop due to a rise in temperature of the fluorescent tube 5 and the electronic lighting circuit 4, and temperature deterioration of electronic parts brings about operational errors or a shorter life expectancy of the electronic lighting circuit 4. Consequently, it is preferable that the external diameter of the globe 1 is between 55 mm and 65 mm, and the total length of the globe 1 is between 65 mm and 80 mm. From the viewpoint of interchangeability with regular light bulbs, it is especially preferable that the external diameter of the globe 1 is 60 mm, which is the same diameter as in regular light bulbs.

Furthermore, in order to balance strength with low weight and small dimensions, the wall thickness of the globe 1 should be in the range of 0.5–1.5 mm, especially preferable is a wall thickness of the globe 1 near 1.0 mm. In order to balance strength with low weight and small dimensions, the wall thickness of the fluorescent tube 5 should be in the range of 0.6–1.2 mm, especially preferable is a wall thickness of the fluorescent tube 5 in the range of 0.8–1.0 mm.

Figure 2:
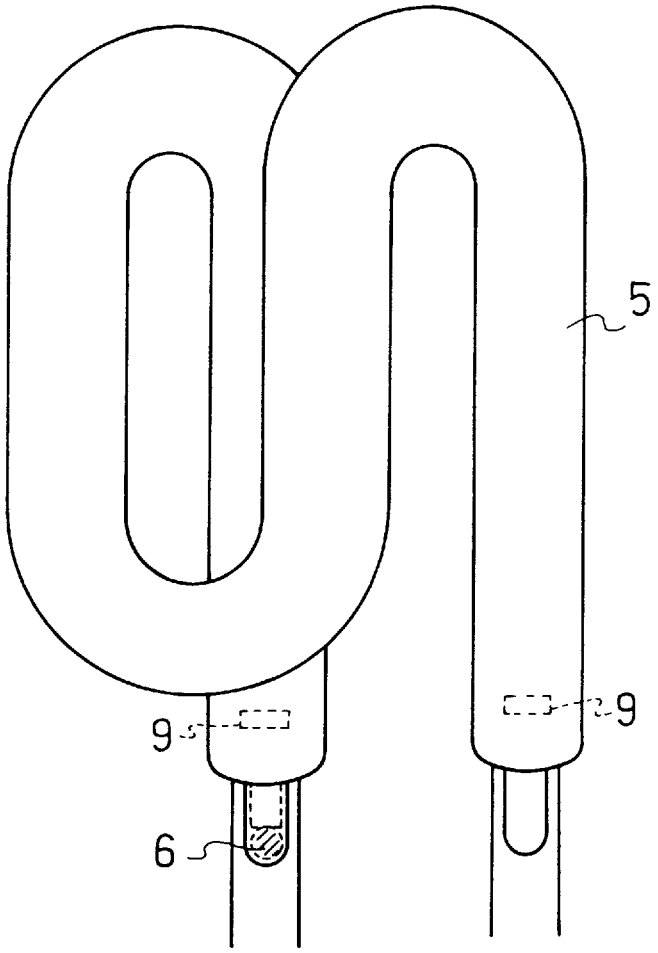
FIG. 2 is a perspective view of the fluorescent tube of the same light-bulb-shaped fluorescent lamp according to a preferred embodiment of the present invention.
Figure 3:
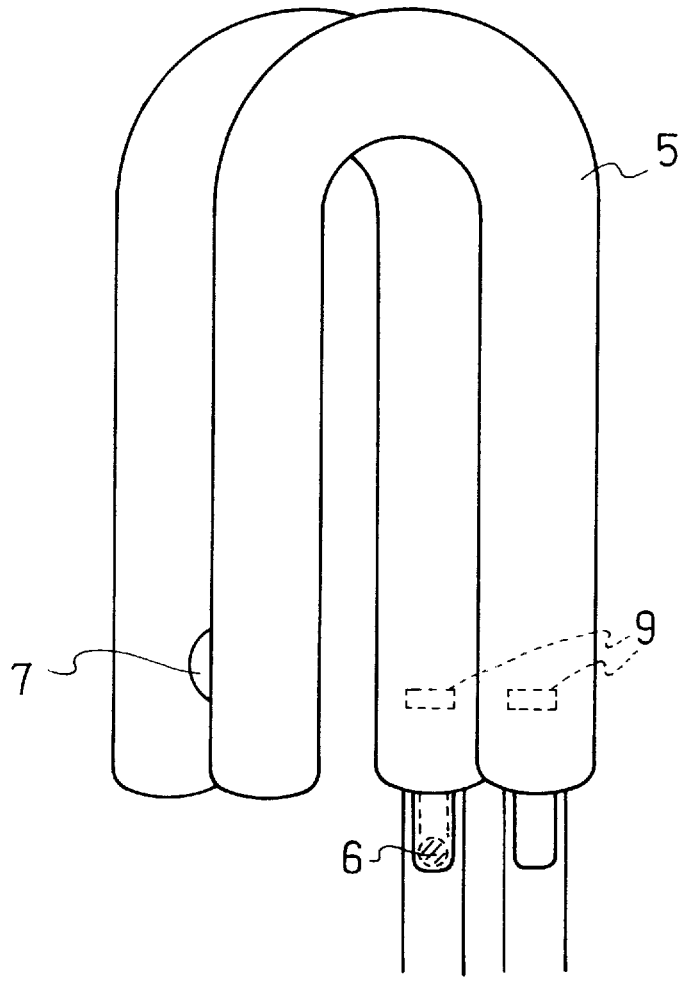
FIG. 3 is a perspective view of a fluorescent tube of another preferred embodiment of the present invention.
Figure 4:
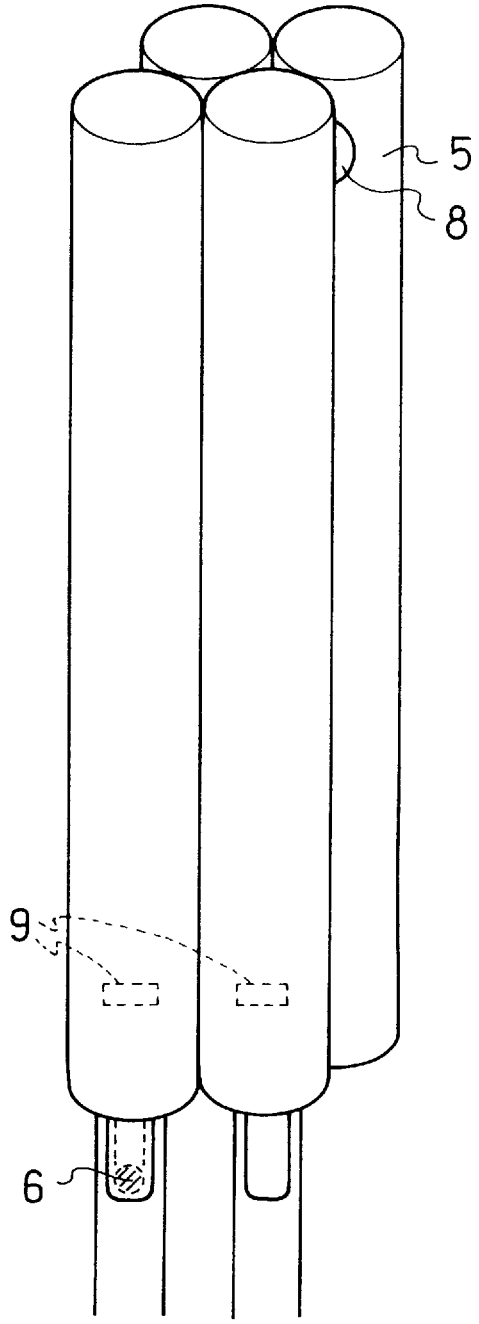
FIG. 4 is a perspective view of a fluorescent tube of yet another preferred embodiment of the present invention.
Figure 5C:
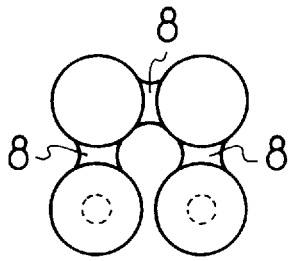
FIG. 5C is a top view of FIG. 4.
Figure 5A:
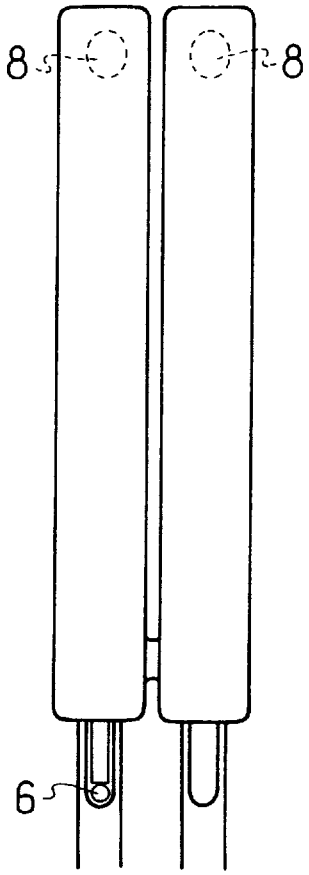
FIG. 5A is a frontal view.
Figure 5B:
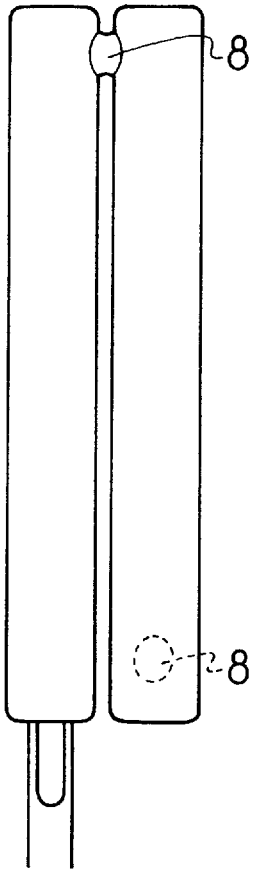
FIG. 5B is a view of the right side.

Alternatively to having three bent portions as shown in FIG. 2, the W-shaped fluorescent tube 5 of the present invention can be a fluorescent tube formed by joining two U-shaped tubes with a bridge 7 (see FIG. 3), or a fluorescent tube formed by joining four straight tubes with three bridges 8 (see FIGS. 4 and 5). FIG. 5A is a frontal view, FIG. 5B is a view of the right side, FIG. 5C is a top view of FIG. 4, and those drawings explain the position of the bridges 8.

As has been explained above, the light-bulb-shaped fluorescent lamp according to the present invention, has high conformity to regular light bulbs, and realizes the same brightness as a regular 60 W light bulb, but with less power consumption than in a conventional light-bulb-shaped fluorescent lamp.

The invention may be embodied in other specific forms without departing from the spirit or essential characteristics thereof. The embodiments disclosed in this application are to be considered in all respects as illustrative and not restrictive, the scope of the invention being indicated by the appended claims rather than by the foregoing description, all changes that come within the meaning and range of equivalency of the claims are intended to be embraced therein.

What is claimed is:

1. A light-bulb-shaped fluorescent lamp, comprising:

a bent fluorescent tube provided with a pair of electrodes at both ends and containing a mercury vapor source and a rare gas;

an electronic lighting circuit lighting the fluorescent tube; and an outer housing, comprising a transparent globe and a case, and accommodating the bent fluorescent tube and the electronic lighting circuit; wherein the external diameter of the globe ranges between 55 mm and 65 mm, the total length of the globe ranges between 65 mm and 80 mm, the wall thickness of the globe ranges between 0.5 mm and 1.5 mm, the internal diameter of the fluorescent tube ranges between 7 mm and 11 mm, the wall thickness of the fluorescent tube ranges between 0.6 mm and 1.2 mm, and the distance between the electrodes ranges between 200 mm and 280 mm.

2. The light-bulb-shaped fluorescent lamp according to claim 1, wherein the fluorescent tube has a tube wall load ranging between 1.4 mW/mm$^2$ and 3.2 mW/mm$^2$ when lit.

3. The light-bulb-shaped fluorescent lamp according to claim 1, wherein the fluorescent tube is a W-shaped fluorescent tube having three bent portions.

4. The light-bulb-shaped fluorescent lamp according to claim 1, wherein the fluorescent tube is formed by joining two U-shaped tubes together near a free end of the two U-shaped tubes with a bridge.

5. The light-bulb-shaped fluorescent lamp according to claim 1, wherein the fluorescent tube is formed by joining four straight tubes together with three bridges.

6. The light-bulb-shaped fluorescent lamp according to claim 1, wherein the mercury vapor source is at least one mercury vapor generating amalgam compound selected from the group consisting of BiPbSnHg, BiInHg, and BiInPbHg.

7. The light-bulb-shaped fluorescent lamp according to claim 1, wherein the rare gas is at least one rare gas selected from the group consisting of argon gas and neon gas.

8. The light-bulb-shaped fluorescent lamp according to claim 1, wherein the distance between the electrodes ranges between 250 mm and 260 mm.

9. The light-bulb-shaped fluorescent lamp according to claim 1, wherein the rated power consumption ranges between 13.8 W and 15.2 W.

10. The light-bulb-shaped fluorescent lamp according to claim 1, wherein the internal diameter of the fluorescent tube ranges between 9 mm and 11 mm.

* * * * *